US009107791B2

(12) United States Patent
Gee

(10) Patent No.: US 9,107,791 B2
(45) Date of Patent: Aug. 18, 2015

(54) CONTAINER FOR CEMETERY MAUSOLEUM

(71) Applicant: Stephen John Gee, Chelsea (CA)

(72) Inventor: Stephen John Gee, Chelsea (CA)

( * ) Notice: Subject to any disclaimer, the term of this patent is extended or adjusted under 35 U.S.C. 154(b) by 25 days.

(21) Appl. No.: 14/080,118

(22) Filed: Nov. 14, 2013

(65) Prior Publication Data

US 2015/0128390 A1 May 14, 2015

Related U.S. Application Data

(63) Continuation-in-part of application No. 13/517,700, filed on Jun. 14, 2012, now abandoned.

(51) Int. Cl.
*A61G 17/08* (2006.01)
*E04H 13/00* (2006.01)

(52) U.S. Cl.
CPC ..... *A61G 17/08* (2013.01); *E04H 13/006* (2013.01)

(58) Field of Classification Search
CPC ..... A61G 17/00; A61G 17/08; E04H 13/00; E04H 13/006; E04H 13/008
USPC ..... 27/1, 35; 52/134, 136, 137; 211/85.27
See application file for complete search history.

(56) References Cited

U.S. PATENT DOCUMENTS

| | | | | |
|---|---|---|---|---|
| 617,161 | A | 1/1899 | Hunter | |
| 3,183,574 | A * | 5/1965 | Diem | 27/1 |
| 3,529,730 | A * | 9/1970 | Thompson | 211/85.27 |
| 3,754,805 | A * | 8/1973 | Pangburn et al. | 312/111 |
| 3,925,944 | A * | 12/1975 | Pickel | 52/134 |
| 4,607,417 | A | 8/1986 | Hancovsky | |
| 4,688,359 | A | 8/1987 | See | |
| 5,195,812 | A * | 3/1993 | Eickhof | 312/257.1 |
| 5,287,603 | A | 2/1994 | Schorman | |
| 5,625,933 | A * | 5/1997 | Neuberger et al. | 27/1 |
| 6,161,268 | A * | 12/2000 | Joseph | 27/35 |
| 2008/0078074 | A1 * | 4/2008 | McCampbell | 27/1 |
| 2013/0212847 | A1 * | 8/2013 | Gee | 27/1 |

* cited by examiner

*Primary Examiner* — William Miller
(74) *Attorney, Agent, or Firm* — IP-MEX Inc.; Victoria Donnelly

(57) ABSTRACT

This inurement container (urn) for cremated remains is designed for use in a Cemetery Mausoleum and to occupy the cavity between a sealed Crypt and its decorative facing. The depth of this container and the design to fit the limited available space within the cavity will allow the use of previously unutilized space for the interment of the cremated remains immediately adjacent to an occupied Crypt without the necessity of disturbing the sealed Crypt.

20 Claims, 5 Drawing Sheets

CONTAINER FOR CEMETERY MAUSOLEUM

RELATED APPLICATIONS

The instant application is a CIP Application of U.S. application Ser. No. 13/517,700 filed on Jun. 14, 2012, which claims priority from corresponding Canadian application serial number 2,769,135 filed on Feb. 17, 2012.

FIELD OF THE INVENTION

The present invention relates to a cremation urn for a cemetery mausoleum, and in particular to a container for inurnment of cremated remains, which is designed to occupy a cavity between a sealed crypt and its decorative facing.

BACKGROUND OF THE INVENTION

A glossary of terms used in the present application is provided below.

Mausoleum: A burial place containing Crypts for the bodies or remains of individuals, usually in the form of a building. In recent years, Mausoleum buildings have tended to become larger incorporating many Crypts and can also include Columbariums. A common decorative feature of Mausolea is they are clad with marble or granite veneer facings which cover Crypt fronts, Columbaria fronts and blank walls.

Crypt: A chamber or vault within a mausoleum for placement or storage of a body or remains of an individual, typically contained within a casket or coffin 24, and which can be hermetically sealed.

Crypt Shutter: The marble or granite decorative veneer facing in front of a Crypt and typically inscribed with information concerning the deceased individual(s) interred within the Crypt. Behind the Crypt Shutter and in front of the sealed Crypt can be an adjustment space of approximately 2" in depth.

Columbarium: A structure with recessed niches within the walls to receive Cremation Urns containing the cremated ashes of the dead. Facing is typically granite or marble, but can also be glass to permit viewing of the Cremation Urn.

Cremation Urn: A container for holding the cremated remains of the dead.

Cemeteries are facing requests from bereaved families to open sealed Mausoleum Crypts, to add a Cremation Urn holding cremated remains. Complying with the request can be difficult~the design of this invention addresses and resolves the problems and offers a new interment option for cremated remains.

With changing burial practices, cremation rates have increased and many cremated remains are interred separately in Columbaria or in-ground. However, some families are requesting that a container holding cremated remains be added to a Mausoleum Crypt in which a family member has previously been interred. Available space within an occupied Crypt can be problematic, as can be the condition of the casket 24 already occupying the Crypt.

A U.S. Pat. No. 5,625,933 to Neuberger describes a decorative Cremation Urn incorporating a mounting system which enables a plurality of identical Cremation Urns to hang together on the exterior of a blank wall, thereby creating a Columbarium like structure.

Other prior art references have been cited in the Information Disclosure Statement for the present invention.

BRIEF SUMMARY OF THE INVENTION

The present application is for a Cremation Urn, or Container 10, which, with its dimensions, minimal depth and simple hanging device, is hidden within the wall of a Mausoleum behind a Crypt Shutter 30.

The container 10 for cremated remains of the present invention is uniquely designed to occupy an existing cavity between the sealed Crypt 20 and its Crypt Shutter 30 (decorative facing), thus avoiding the necessity of disturbing the sealed Crypt 20. It also offers a new interment option for cremated remains.

A Mausoleum container 10 for cremated remains, comprised of a formed or moulded container of approximately 200 cubic inch capacity with a depth of M3=1½", thereby enabling it to take advantage of the existing narrow, unutilized space that exists within the front wall of a Mausoleum Crypt 20 between the sealed Crypt 20 and its decorative facing or Crypt Shutter 30. It incorporates a hook 12 like appendage to hang on the interior face 32 of a Crypt Shutter 30 which, when closed and permanently fastened, hides the Cremation Urn 10 from view.

DETAILED DESCRIPTION OF THE EMBODIMENTS OF THE INVENTION

Figure 1:
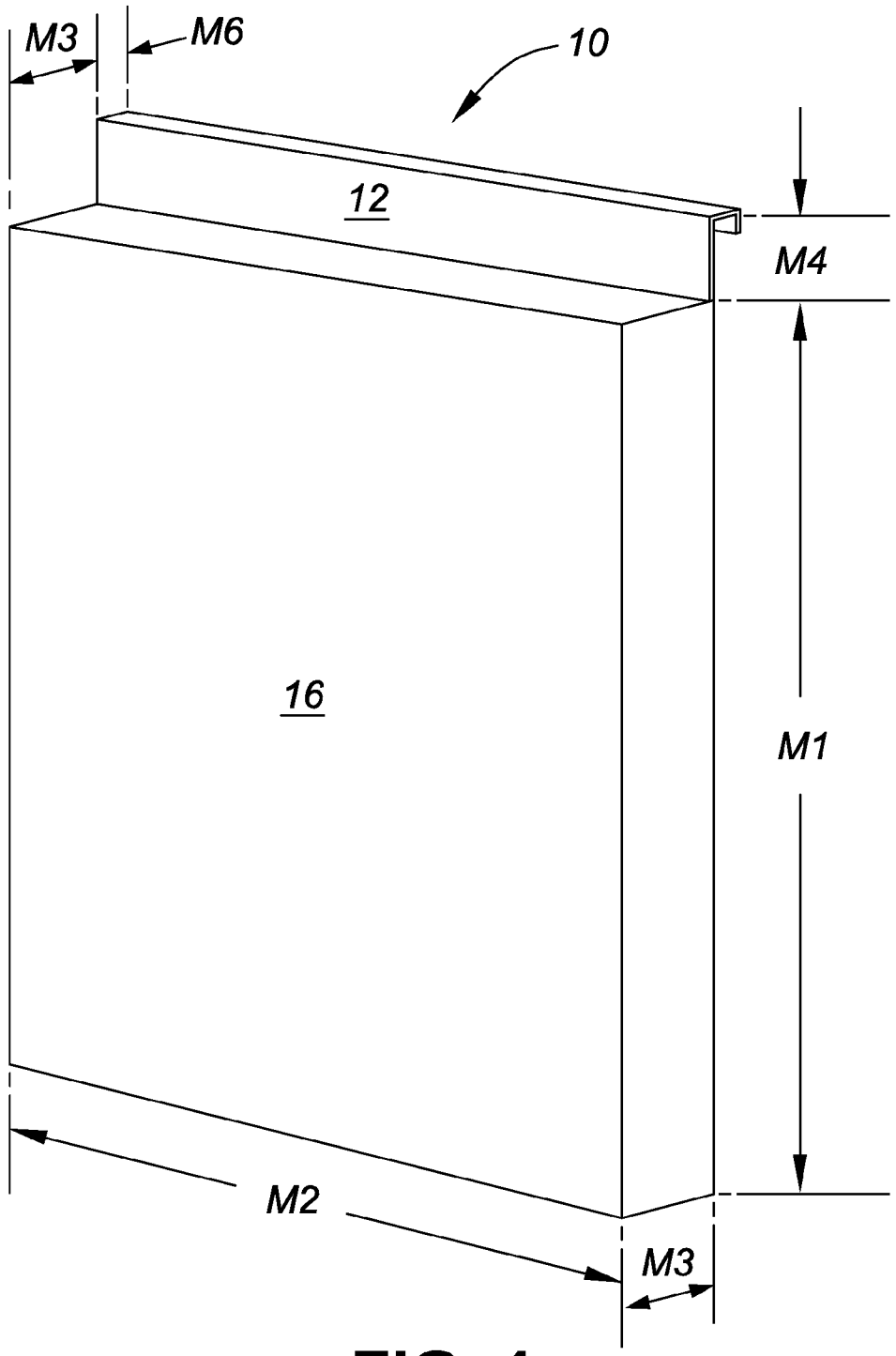
FIG. 1 illustrates a front view of the Container 10 of the embodiment of the present invention.
Figure 2:
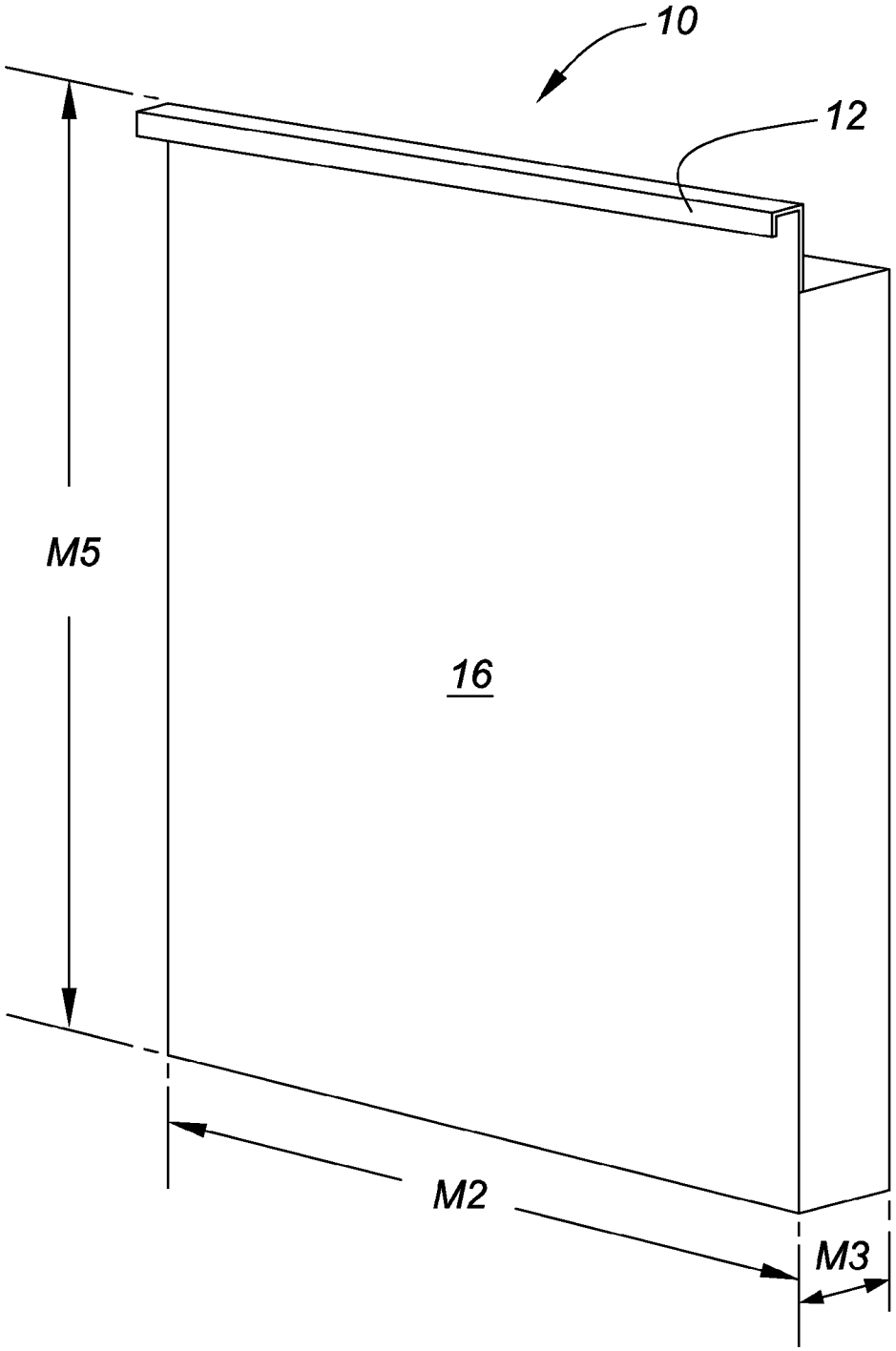
FIG. 2 illustrates a back view of the Container 10 of FIG. 1.
Figure 3A:
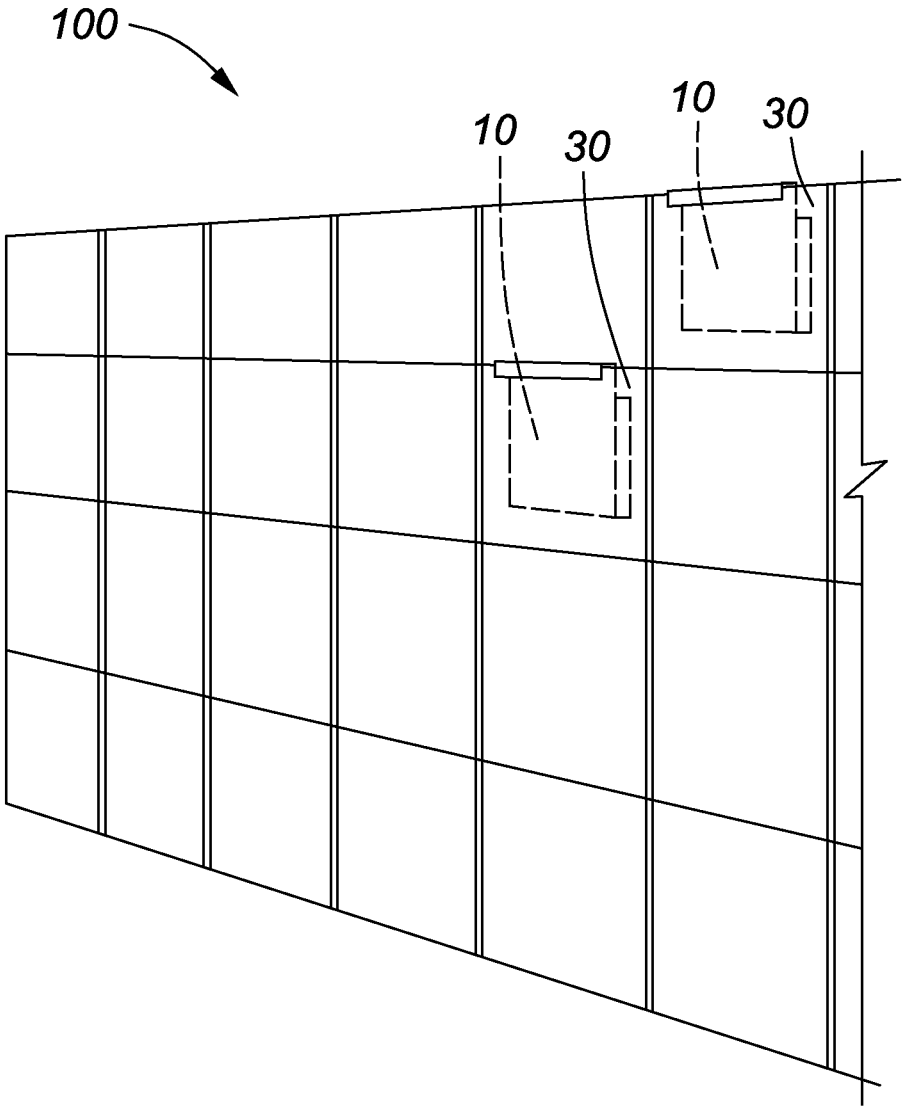
FIG. 3A illustrates a front wall of a mausoleum with crypt shutters, with containers 10 of the present invention being shown in dashed lines behind crypt shutters.
Figure 3B:
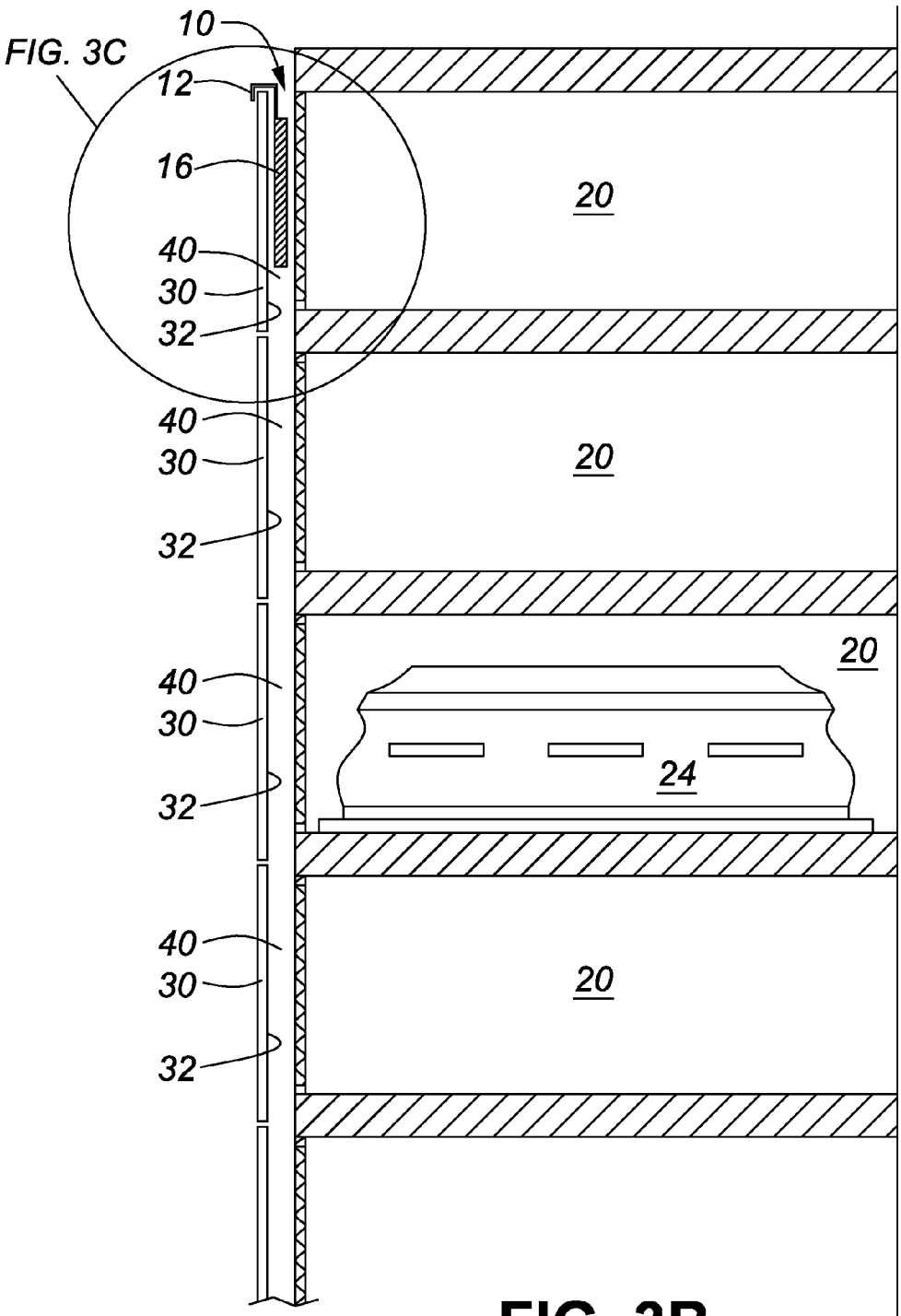
FIG. 3B illustrates a side view of the front wall of FIG. 3A, showing the Container 10 of the present invention hanging on the interior wall of a crypt shutter.
Figure 3C:
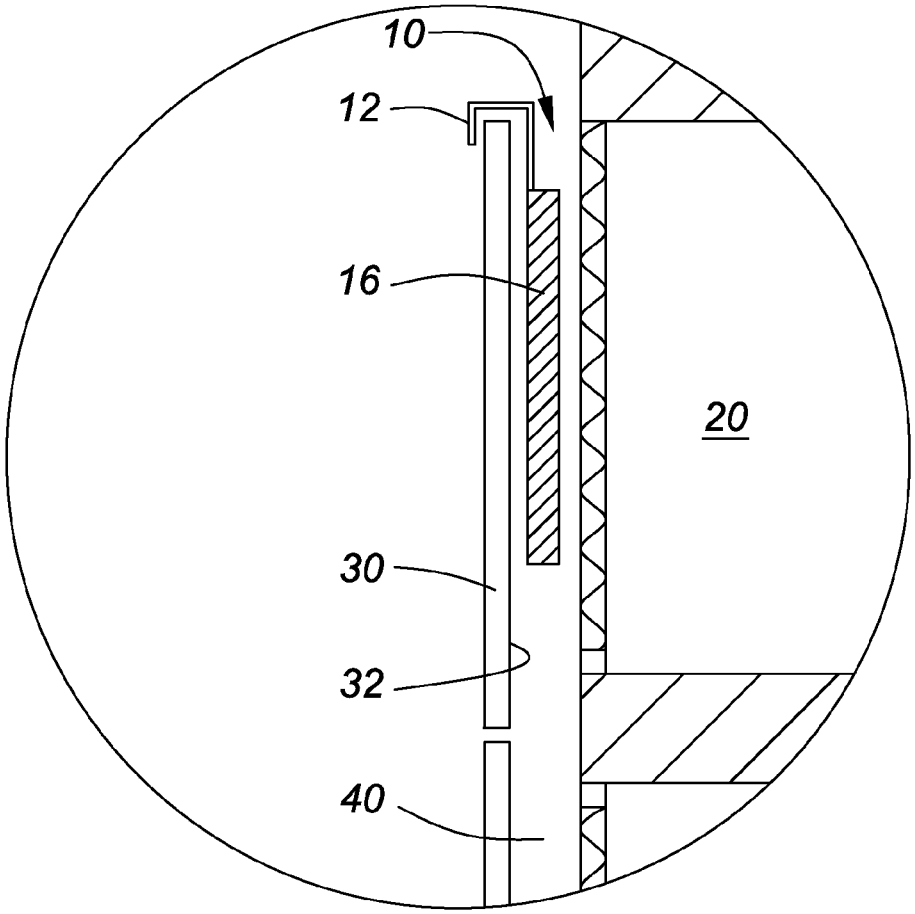
FIG. 3C shows an enlarged portion of FIG. 3B with the Container 10.

Container 10 for a Cemetery Mausoleum for inurnment of cremated remains and designed to occupy a cavity 40 between a sealed Crypt 20 and its decorative facing 30.

This invention is a storage container (urn) 10 for cremated remains specifically shaped to occupy an existing cavity 40 within the wall of a Crypt 20, between a sealed Crypt 20 and its Crypt Shutter 30. It is designed to hang on the back 32 of the Crypt Shutter 30, embedded within the wall and hidden between the sealed Crypt 20 and its decorative facing (Crypt Shutter) 30.

Dimensions of the Container 10 are as follows:

Overall height: M5=16½"=M1+M4

Height M1 of containment canister 16: M1=15"

Overall width: M2=10"

Depth: M3=1½"

Hanger depth: M6=15/16"

Hanger height: M4=1½".

This Urn 10 for Mausoleum Crypts 20 is designed to have a capacity of approximately 200 cubic inches with a closable opening to admit cremated remains, and is formed with sheet metal or similar material.

The embodiments of the invention in which an exclusive property or privilege is claimed are defined as follows:

1. A combination of a sealed mausoleum crypt, a decorative crypt shutter positioned adjacent to and in front of a front wall of the sealed mausoleum crypt, and a container for cremated remains, the combination comprising:

the container comprising a canister and a hook shaped appendage;

the container canister defining an interior for receiving the cremated remains therein;

the hook shaped appendage extending from the container canister for hanging the container on an interior face of the decorative crypt shutter such that the container is positioned between the interior face of the decorate crypt shutter and the front wall of the sealed mausoleum crypt, thereby substantially concealing the container from view.

2. The combination of claim 1, wherein the container canister has an approximate volume of 200 cubic inches.

3. The combination of claim 1, wherein the container canister has an approximate depth of 1.5 inches.

4. The combination of claim 1, wherein the container canister has a substantially parallelepiped shape.

5. The combination of claim 1, wherein the container canister has a height of about 15 inches.

6. The combination of claim 1, wherein the container canister has a width of about 10 inches.

7. The combination of claim 1, wherein the hook shaped appendage has a depth of about 15/16 of an inch, and a height of about 1.5 inches.

8. The combination of claim 1, wherein the hook shaped appendage has a width, which substantially corresponds to a width of the container canister.

9. The combination of claim 1, wherein the container canister has a closable opening for admitting the cremated remains.

10. The combination of claim 1, wherein the container is made of metal material.

11. A combination of a decorative crypt shutter adapted to be positioned adjacent to and in front of a front wall of a sealed mausoleum crypt, and a container for cremated remains, the combination comprising:

the container comprising a canister and a hook shaped appendage;

the container canister defining an interior for receiving the cremated remains therein;

the hook shaped appendage extending from the container canister for hanging the container on an interior face of the decorative crypt shutter such that the container is positioned between the interior face of the decorate crypt shutter and the front wall of the sealed mausoleum crypt, thereby substantially concealing the container from view.

12. The combination of claim 11, wherein the container canister has an approximate volume of 200 cubic inches.

13. The combination of claim 11, wherein the container canister has an approximate depth of 1.5 inches.

14. The combination of claim 11, wherein the container canister has a substantially parallelepiped shape.

15. The combination of claim 11, wherein the container canister has a height of about 15 inches.

16. The combination of claim 11, wherein the container canister has a width of about 10 inches.

17. The combination of claim 11, wherein the hook shaped appendage has a depth of about 15/16 of an inch, and a height of about 1.5 inches.

18. The combination of claim 11, wherein the hook shaped appendage has a width, which substantially corresponds to a width of the container canister.

19. The combination of claim 11, wherein the container canister has a closable opening for admitting the cremated remains.

20. The combination of claim 11, wherein the container is made of metal material.

* * * * *